United States Patent [19]

Orban

[11] Patent Number: 4,569,258

[45] **Date of Patent: * Feb. 11, 1986**

[54] POWER DRIVEN STUD TENSIONING DEVICE

[76] Inventor: Joseph N. Orban, 12 Greensview Rd., Scotch Plains, N.J. 07076

[ * ] Notice: The portion of the term of this patent subsequent to Feb. 16, 1999 has been disclaimed.

[21] Appl. No.: 740,873

[22] Filed: Jun. 3, 1985

Related U.S. Application Data

[63] Continuation of Ser. No. 348,243, Feb. 12, 1982, abandoned, which is a continuation-in-part of Ser. No. 34,500, Apr. 30, 1979, Pat. No. 4,315,446.

[51] Int. Cl.[4] ..... B25B 29/02

[52] U.S. Cl. ..... 81/57.38; 254/29 A

[58] Field of Search ..... 81/57.38; 254/29 A; 279/66, 110, 1 H

[56] References Cited

U.S. PATENT DOCUMENTS

| | | | |
|---|---|---|---|
| 2,780,470 | 2/1957 | Ridout | 279/66 |
| 3,877,326 | 4/1975 | Kock et al. | 81/57.38 |
| 4,027,559 | 6/1977 | Wallrafen | 81/57.38 |
| 4,047,456 | 9/1977 | Scholz | 81/57.38 |
| 4,273,011 | 6/1981 | Exner et al. | 81/57.38 |
| 4,314,690 | 2/1982 | Mlynarik et al. | 81/57.38 |
| 4,315,446 | 2/1982 | Orban | 81/57.38 |

*Primary Examiner*—James L. Jones, Jr.
*Attorney, Agent, or Firm*—Edward R. Weingram

[57] ABSTRACT

A power driven stud tensioner device which connects to an engaging member integral with or connected to a stud to be placed in tension after which a nut on the stud is tightened. The device for placing the stud in tension is a cam actuated clamping assembly having a plurality of layers wherein motion of one component translates into a different motion in another component. The device includes a helically slotted actuating sleeve which receives cam pins passing through an axially slotted stationary ring which are then received in one of two inner camming rings which are axially shifted by the pins in response to rotation of the sleeve. Rotation of the actuating sleeve, which is driven externally by a power drive including a gear assembly connected to the sleeve, will cause the camming rings to move into and out of engagement with cam followers formed on, or attached to, a four segmented clamp which is thus moved into, and out of, locking engagement with the engaging member.

15 Claims, 7 Drawing Figures

109
107
105
98
118
111
117
70
103
94
102
162
168
10
158
68
3
132
156
3
16
100
75
72
156
64
73
76
160
12
162
74
60
58

54
50
48
44
14
46
40
55
58
53
42
57
56
52
60
50
48
56
54
55
57
34
32
66
36
28
15
18
24
38
25
30
26
22
20

POWER DRIVEN STUD TENSIONING DEVICE

This application is a continuation of Ser. No. 06/348,243, filed Feb. 12, 1982, now abandoned, which is a continuation-in-part of Ser. No. 06/034,500, filed Apr. 30, 1979, which is now U.S. Pat. No. 4,315,446, the entire disclosures of which are incorporated herein by reference.

BACKGROUND OF THE INVENTION

1. Field of the Invention

This invention relates to fastening devices and more specifically to devices to apply tension to fastening devices such as studs, bolts and the like.

2. Description of the Prior Art

The stud tensioners of the prior art used various means and methods to attach the stud and engaging member. The attachment of the tensioner stud is an important function in the operation of the tensioning devices. Tensioners are often used on more than one fastening device when assembling or disassembling an apparatus, for example, large pressure vessels. Therefore, the tensioner must be disengaged and reengaged each time they are shifted from one fastener to another. The engaging and disengaging processes for the tensioner can be time consuming, resulting in lengthened down time for the apparatus being serviced. The increased down time results in increased expense and very often increased hazard to the personnel engaged in servicing the apparatus.

Additionally, the means for attaching prior art tensioners are often bulky and require large spaces in which to operate. Extensive disassembly of the apparatus being serviced or equipment being connected to this apparatus is necessary in order to obtain the required working space.

Reliability of the tensioner attaching device is also an important factor. Often prior art devices required threaded connections whicn could easily be compromised by cross threading which resulted from even minor misalignment of the elements when engaging the tensioner.

In summary, the structure and operation of the prior art tensioners was complex and costly, and not always reliable.

SUMMARY OF THE INVENTION

In accordance with the invention, a stud tensioner device connects to an engaging member integral with or connected to a stud to be placed in tension to permit a nut on the stud to be tightened. The stud is usually in a high pressure application such as a pipe line or various types of pressure vessel. The device for connecting to the engaging member is a cam actuating and clamping assembly having a plurality of layers wherein motion of one component translates into a different motion in another component. The device includes a helically slotted actuating sleeve which receives cam pins passing through an axially slotted stationary ring wnich are then received in one of two inner camming rings which are axially shifted by the pins responsive to rotation of the sleeve. Rotation of the actuating sleeve externally driven by a motor driven gear set connected to the sleeve will cause the camming rings to move into and out of engagement with cam followers formed on or attached to a four segment clamp which is thus moved into and out of locking engagement with the engaging member.

To facilitate the clamping engagement and release of the engaging member corresponding parallel circumferential ribs are formed on the clamp segments and the engaging member. Once clamped to the engaging member, hydraulic pistons associated with the device will be activated to place the stud in predetermined tension. A chuck device is associated with the assembly and will rotate the nut on the stud to the tightened position. Thereafter the hydraulic pressure is released allowing the clamps to be disengaged.

To facilitate engagement of the clamp to the head of the stud, the head of the stud and clamp are slightly tapered so that the clamp firmly grips the stud.

Accordingly, an object of the present invention is to provide a device for tensioning stud bolts and the like which includes a novel cam actuated and clamping assembly which overcomes the prior art disadvantages.

Another object of the present invention is to provide a device for tensioning stud bolts and the like which is simple, economical and reliable.

A further object of the present invention is to provide a device for tensioning stud bolts and the like which is cam actuated.

Still another object of the present invention is to provide a device for tensioning stud bolts and the like which has an external power driven actuator having a plurality of layers wherein motion of one component translates into a different motion in another component.

Yet another object of the present invention is to provide a device for tensioning stud bolts and the like which has an externally power driven sleeve moved in one direction to lock and in the opposite direction to release the fastener.

Stiil a further object of the present invention is to provide a device for tensioning stud bolts and the like wnich has a segmented bar clamping member for receiving a tapered stud, the taper to facilitate engagement of the clamping members and stud.

Yet a further object of the present invention is to provide a device for tensioning stud bolts and the like which clamping member includes cam followers for clamping and releasing the engaging member.

Another object of the present invention is to provide a device for tensioning stud bolts and the like which uses axially movable cam rings to shift the clamping member segments.

Yet another object of the present invention is to provide a device for tensioning stud bolts and the like which uses a stationary ring to guide the motion of the cam rings.

A further object of the present invention is to provide a device for tensioning stud bolts and the like which device is self aligned on the engaging member as a result of a tapered end of the stud.

Other objects and advantages will be apparent from the following description of one embodiment of the invention, and the novel features will be particularly pointed out hereinafter in the claims.

BRIEF DESCRIPTION OF THE DRAWINGS

This invention is illustrated in the accompanying drawings in which.

DESCRIPTION OF A PREFERRED EMBODIMENT OF THE INVENTION

Figure 1:
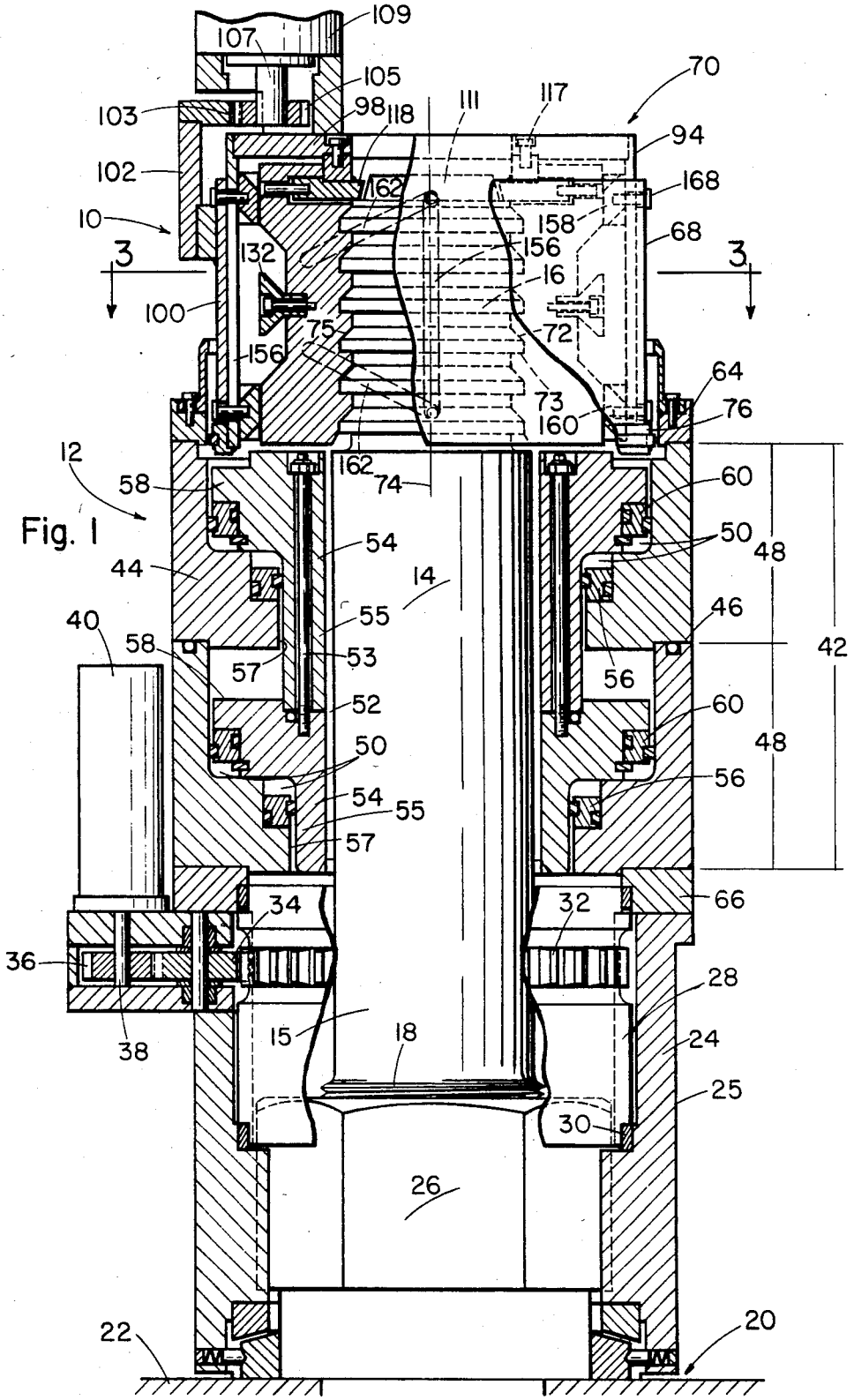
FIG. 1 is an elevational view, partly in section, of a stud tensioner embodying the present invention in the closed position.

In the illustrated embodiment of the invention the improved stud tensioner device 10 shown in FIG. 1 includes a housing 12 which encloses a stud 14 having an engaging member 16 formed at the upper end thereof above the threaded section 18 of the stud 14.

The lower section 24 of the housing 12 has a circular wall 25 the bottom edge of which sits upon the structure 22 while it encircles the stud 14 and a nut 26 threadably connected to the threads 18 of the stud 14 as illustrated in FIG. 1. A socket 28 having a circular circumference is rotatably carried on an internal annular shoulder 30 of the wall 25. A ring gear 32 is mounted on the outer wall of the socket which meshes with an idler gear 34 driven by gear 36 attached to the shaft driven by motor 40. The interior of the socket 28 is polygonal to mate with the polygonal nut 26 and whenever the socket is rotated the nut 26 will also be rotated; in one direction to tighten and in the opposite direction to loosen.

A mid-housing section 42 is connected to the lower housing section 24, and has a circular housing 44 which is horizontally split at 46 to permit access to a double power unit 48, 48. Since each unit 48 is the same only one need be described and like reference characters will be used for each.

The wall 44 has an internal radially outwardly extending recess 50 which forms a cylinder, for a piston 54, extending from a central opening 52 spaced from the stud or engaging member. An annular piston 54, has a lower portion or piston rod 55 which fits between the inner wall 52 of housing 44 and the stud 14 or engaging member 16. Cylinder 50 is sealed at its lower end by static seal assembly 56 and at its upper end by dynamic seal assembly 60. A piston head 58 extends from the piston 54 and fits within the recess or cylinder 50 to be sealed by the seal assemblies 56 and 60. A tie rod 53 threadably connects the upper and lower pistons 54.

Fluid under pressure will be admitted to the underside of the piston head 58 between the seal assemblies 56 and 60 from a duct, not shown, to actuate the piston head 58 and raise it, and through intermediate members, upper end plate 64 which sits atop the upper surface of the housing 44. A lower end plate 66 supports the bottom edge of the lower housing 44 when the piston 58 is actuated.

The piston heads 58 vertically rise to increase the distance measured from the top of the respective piston heads 58 down to the bottom of the wall 25 as it sits on the top surface of the structure 22. The piston rods 54 have an axial passage therethrough for the engaging member 16 to extend and to be activated upwardly by the action of the piston heads 58 as is more fully described hereinafter.

The fluid under pressure is preferably oil from a suitable source controlled by a valve (not shown) and supplied to the oil duct (not shown). Once the piston heads 58 are in the raised position they may be restored to the lowered position by removal or exhausting of the oil by suitable means (not shown) and by injection of and between the upper cylinder 50 and the top of lower piston head 58. The air pressure forces lower piston 54 down which in turn pulls upper piston 54 down by means of tie rod 53.

The upper housing section 68 embodies the improved cam and clamp assembly, designated generally 70, which acts to clamp or release the engaging member 16 as depicted in FIG. 1.

The engaging member 16 illustrated in FIG. 1 has a plurality of circumferential parallel ribs 72 spaced apart longitudinally of the engaging member 16, the underside 73 of each being flat and in a plane substantially normal to the axis 74 of the engaging member 16 and stud 14, while the upper side 75 is beveled to extend upwardly and inwardly. Other shapes and configurations can also be used.

Figure 2:
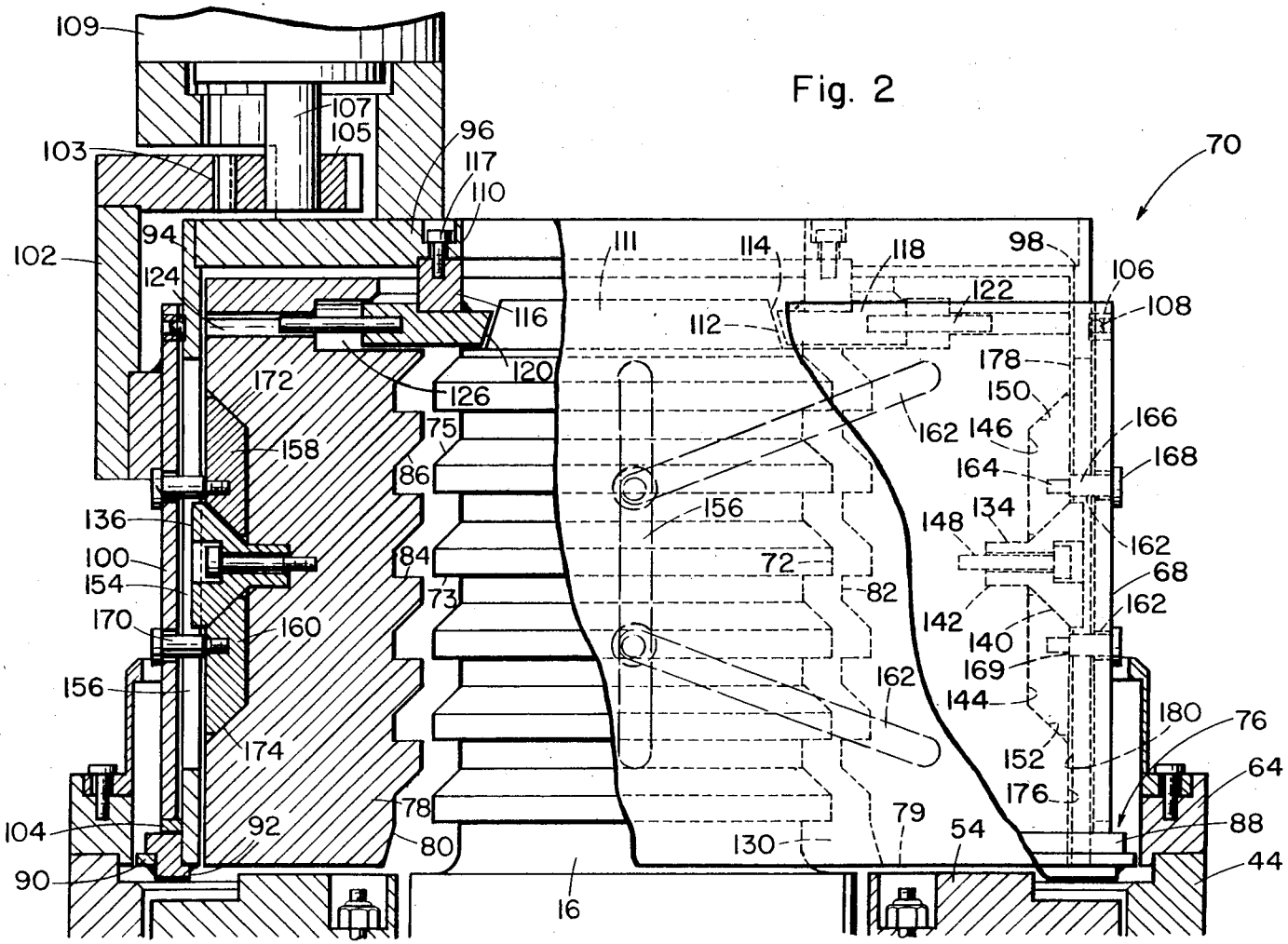
FIG. 2 is an elevational view, partly in section, showing a portion of the cam actuating and clamping assembly in the open position.
Figure 4:
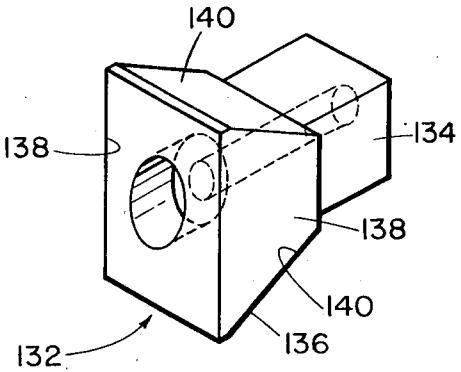
FIG. 4 shows the cam follower.

The cam and clamp assembly 70 has a stationary housing 76 which carries a segmented split socket or puller clamp 78 (FIG. 2) having segments 79 whose interior faces 80 have a plurality of circumferential parallel ribs 82 corresponding in cross section to the spaces between the ribs 72 of the engaging member 16, and having flat upper sides 84 formed in planes parallel to and slidably contactable with the lower sides 73 of the ribs 72. The underside 86 of the ribs 82 are beveled outwardly and downwardly at a slope equal to that of the upperside 75 of the ribs 72 as illustrated in FIG. 2.

The stationary housing 76 includes an outer ring 88 which has diametrically opposite lugs or keys 90 affixed to the external periphery thereof. The ring 88 sits inside the upper end plate 64 of the mid-housing section 42 and the lugs 90 are fitted within recesses on the end plate 64 so as to properly position the upper housing section 68 as it rests upon the mid-housing section 42. The ring 88 has a set back annular shoulder 92 formed on its inner diameter which receives an upstanding stationary sleeve 94 and is welded thereto.

A top plate 96 is connected to the stationary sleeve 94 by welding and will set upon a shoulder 98 thereof. An arm 102 is welded to a slightly shorter actuating sleeve 100 which is rotatably disposed about the stationary sleeve 94 and positioned between a lower thrust washer 104 which sits atop the ring 88 and an upper thrust washer 106 connected to the stationary sleeve 94 just above the top of the actuating sleeve 100 by a plurality of set screws 108, one of which is shown in FIG. 1. Arm 102 is connected to a sector gear 103 driven by a gear 105 attached to a shaft 107 of a motor 109.

The top plate 96 has a central opening 110 through which a necked down section 111 of the engaging member 16 extends. A tapered section 112 of intermediate diameter is formed below section 111 and terminates in the full diameter engaging member 16. The sides 114 of section 112 are sloped upwardly and inwardly.

A spacing collar 116 is connected by a plurality of circumferentially disposed cap screws 117 to the underside of the top plate 96 about the opening 10 on the top plate. lower horizontal collar 118 is weld-connected to the spacing collar 116 so as to extend on either side of the annular collar 116. The inner circumference of the collar 118 has a sloped side 120 set at the same angle as that of the tapered section 112 so as to act to align the upper housing section 68 with the engaging member 16.

A plurality of steel dowel pins 122 are connected into the outer circumference of the collar 118 to extend radially outwardly therefrom and to be engaged in alignment and support apertures 124 formed at the vertical base of an annular radially extending recess 126 extending from the interior of the upper end of the split sockets or segments 79 of the clamps 78.

The outer end of the horizontal collar 118 is slidingly received in the recess 126 and along with the pins 122 also acts to support and align the segments 79 of the clamp assembly 78. The guide collar 118 and guide pins 122 also acts to support and align the segments 79 of the clamp assembly 78. The guide collar 118 and guide pins 122 will limit the movement of the segments 79 to that of a one dimensional horizontal plane, of in or out, wherein it will assume a clamped (closed) or released (open) position relative to the engaging member 16 as seen in FIG. 3.

The ribs 72 and 82 have the mating flat sides 73 and 84 formed so as to improve contact therebetween as the upper housing is urged upwardly as the pistons 54 are actuated. The mating ribs 72 and 82 respectively can be formed of any suitable size and shape to withstand the forces to be applied by the power units 48 which will, as hereinafter described, act to tension the fastener stud 14 via the engaging member 16. The possibility of damaging the relatively fragile nut threads 18, is eliminated by transmitting the tensioning forces through the engaging member, while also greatly increasing the speed and accuracy of tightening the nuts 26 to produce the desired predetermined load in the stud.

Figure 3:
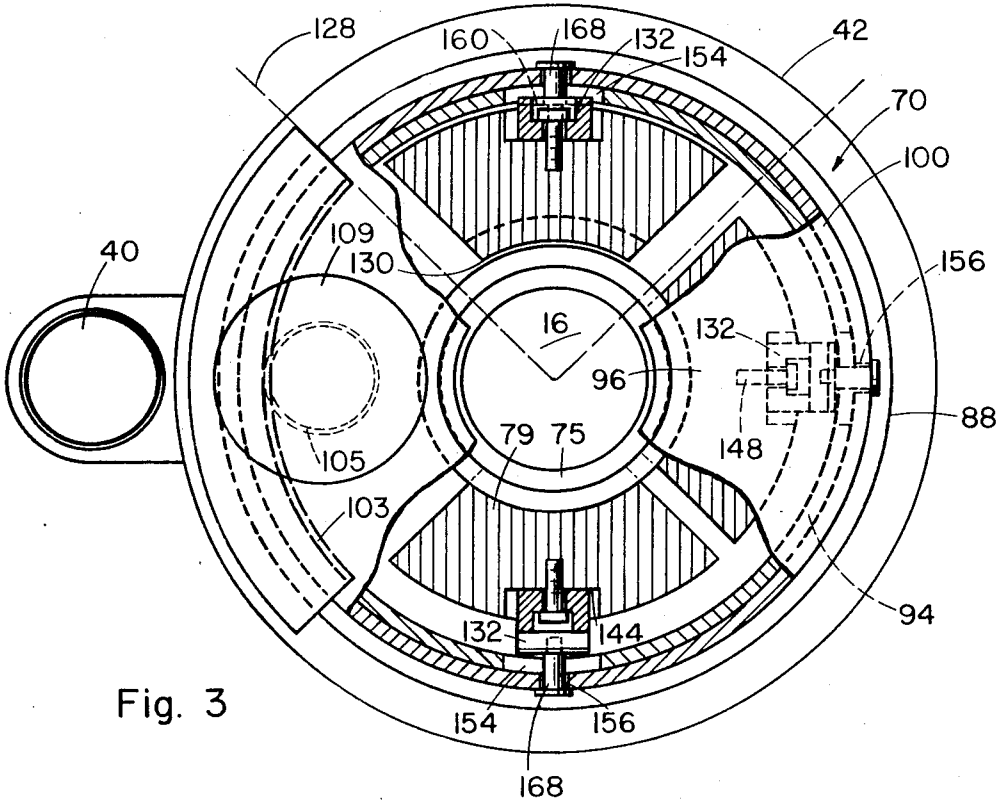
FIG. 3 is a composite sectional plan view taken along line 3—3 of FIG. 1, showing a four segment clamp, with three of the four segments in the closed position, while the uppermost segment is in the open position which is indicated to be a different condition by the dashed separation lines.

Each of the four segments 79 is arcuately shaped as shown in FIG. 3 and will encircle the engaging member 16 with the ribs 82 out of contact when the segment 79 is in the open position as shown in the single segment 79 at the rightmost position of FIG. 3 and separated from the remaining three segments 79 by a quarter pie-shaped dotted line 128. In the open position there will exist an annular space 130 between the outer circumference of the engaging member 16 and the inner circumference of the segments 79. In the remainder of FIG. 3 represented by the three-quarter pie shape on the left side of line 128 the space 130 will not exist as the ribs 82 of the segments 79 mate with the ribs 72 of the engaging member 16 upon the clamp 78 being activated to the closed position to clamp engaging member 16.

A wedge-shaped cam follower 132 illustrated in FIGS. 1 through 4 has a square base 134 and an enlarged rectangular head 136 having long flat vertical sides 138 and short sloped horizontal sides 140. A square opening 142 is formed in the vertical wall 144 of a horizontally extending recess 146 formed at substantially the middle of the outer circumference of each of the segments 79 and extending into the segment. The square opening 142 receives the square base 134 of the cam follower 132 which is connected in place by a screw 148 threadably received in the segment 79 at the base of the opening 142. The head of the screw 148 is countersunk into the head 136 of the follower 132 so as not to be visible in profile (see FIG. 3). A small portion of the square base 134 projects from the opening 142 which lies just below the vertical mid-point of the segment 79 at each of the quadrant lines (see FIGS. 1 or 2) from which the sides 140, 140 flare upwardly and downwardly to terminate in the outer horizontal edges of the head 136.

The recess 146 has an upper side 150 tapered upwardly and outwardly from the base 144 to the outer circumference at an angle substantially parallel to the slope of the adjacent upper side 140, of the follower 132. Similarly recess 146 has a lower side 152 tapered downwardly and outwardly from the base 144 to the outer circumference at an angle substantially parallel to the slope of the adjacent lower side 140 of the follower 132. Each of the sides 140, 140, 150 and 152 define cam follower surfaces as described more fully hereinafter.

The recesses 146 formed in each of the segments 79 are aligned with each other so as to define a horizontal band which extends a predetermined distance above and below the mid-point of the outer circumference of the respective segments 79. In each quadrant the cam follower 132 is connected to the segment 79 as shown in FIG. 3.

The stationary sleeve 94 has a square cut hole 154 at each of the quadrants radially outwardly of and aligned with each of the cam followers 132. These holes provide a radial space for the cam head 136 which extends radially outwardly from the outer surface of the segments 79 a distance not greater than the thickness of the stationary sleeve 94. Therefore, when the segment 79 is in the open position it may nest within the hole 154, as best shown in FIG. 2.

The stationary sleeve 94 as illustrated in FIGS. 2 and 3 has a long axial slot 156 running a vertical distance greater than the recess 146 but less than the total height of the segment 79. There are four slots 156 each formed to the left of the respective quadrant line as seen in FIGS. 2 and 3.

An upper cam or actuating ring 158 and a lower cam or actuating ring 160 are disposed about the segments 79 with ring 158 above the follower 132 and ring 160 therebelow each inwardly of the stationary sleeve 94. The actuating sleeve 100 has pairs of converging slots 162, 162 associated with each of the axial slots 156 in stationary sleeve 94. Each ring 158, 160 has a tapped hole 164 aligned with the axial slot 156. Axially spaced shoulder screws or cam pins 166 are passed radially inwardly through the slanted slots 162 and the axial slot 156 to be threadedly connected in the tapped hole 164. The axial slots 156 of the stationary sleeve 94 will act to limit the movement of the pins 166 to vertically up or down corresponding to the direction of rotation of the sleeve 100 so as to have distance between the slanted slots 164 increasing or decreasing and therefore to produce a like movement in the pins 166 and rings 158, 160 either toward or away from each other between an open position. In FIG. 2, the pairs of pins 166 are axially spaced closest together, in the open position. In FIG. 1 wherein the pairs of pins 166 are axial spaced farthest from each other which is substantially equal to the length of the axial slot 156 which is the closed position.

Each of the pins or followers 166 has a head 168 which is shown larger than the width of the slot 162, though it need not be, but which extends within slot 162 to act as a cam follower. Each pin 166 has a shoulder 169 which contacts the appropriate cam ring 158 and 160 and, therefore, prevents the pin 166 from free inwardly radial movement. Each pin 166 has a shank 170 with a diameter sized to permit sliding within the slots 156 and 162, and a length substantially equal to the combined widths of the sleeves 94 and 100. Therefore there is sufficient radial clearance to permit relative movement of the sleeve 100 and rings 158 and 160 without substantial or excessive radial movement thereof. Accordingly, the actuating sleeve 100 is free to rotate in either direction; the pins 166 and the rings 158, 160 are free to move vertically toward or away from each other; the segments 79 are free to move horizontally toward or away from the engaging member 16.

The cam rings 158, 160 illustrated in FIGS. 1, 2 and 3 have a cross-section of a parallelogram wherein the vertical sides are parallel to the sleeves 94 and 100 and upper and lower sides 172 of ring 158 are parallel to the upper side 150 of the recess 146, while the upper and lower sides 174 of ring 160 are parallel to the lower side 152 of the recess 146.

Motor 109 will rotate the actuating sleeve 100 in two directions. Assuming the clamp assembly 70 is in the open position (see FIG. 2), the sleeve 100 will be rotated to shift the pins 166 from their axial close together position in which the rings 158, 160 are seated within the recess 146 on either side of the cam follower 132. The slope of the pair of slanted slots 162 is divergent so that rotation of sleeve 100 shifts the pair of the pins 166 axially within the confines of the slot 156 causing the slanted sides 172 and 174 of rings 158, 160 to cam against the respective sides 150 and 152 of the recess 146 to shift each of the segments 79 horizontally toward the engaging member 16.

Opposite rotation of the sleeve 100 will result in the cam and clamp assembly 70 reaching the closed posiion illustrated in FIG. 1 wherein the pair of pins 166 is axially spread farthest apart to cause the radially inner side 176 of rings 158, 160 to cam against the outer surface 178 of the segment 79 above and below the recess 146 with the outer radial side 180 of the rings 158, 160 bearing against the inner surface of the stationary sleeve 94 to cause the ribs 72, 82 to be tightly interlocked in mated and clamped position wherein each of the segments 79 has closed upon the engaging member 16 to place the segmented puller clamp 78 in its closed position of FIGS. 1 and 3.

After tensioning the engaging member 16 and tightening of the nut 26 and releasing the tension, the clamp assembly 70 may be returned from the closed (FIG. 1) position to the open (FIG. 2) position by reversing the drive of motor 109 to rotate the sleeve 100 in the opposite direction. The slanted slots 162 converge upon rotation to shift the pair of pins 166 axially within the slot 156 toward each other to slide rings 158, 160 towards each other and remove the sides 176 of the rings from the outer surface 178 of the segments. The sloped sides 172 and 174 of the rings enter the recess 146 and slidingly contact the radially outwardly extending sides 140, 140 of the cam follower 132 to urge the segments 79 radially outwardly away from the engaging member 16 to disengage the ribs 72, 82 respectively and unclamp the engaging member 16. Continued rotation of the sleeve 100 will restore the open position of the clamp assembly 70 shown in FIGS. 2 and 3.

Whenever it is desired to tension (tighten) the stud 14 the stud tensioner device 10 will be placed over the stud 14 and engaging member 16 by suitable lifting means such as hooks (not shown).

The clamp assembly 70 will initially be in the open position and the upper end plate 64 will act as a base plate for the upper housing section 68 with alignment collar 118 axially aligning the engaging member 16 relative the housing section 68 to position the clamp assembly 70 as shown in FIG. 2. Thereafter then engaging member 16 will be clamped by actuation of the clamp assembly 70 to close the segments 79 of the segmented puller clamp 78 as described before. This will place the clamp assembly 70 in the closed position shown in FIG. 1 with the engaging member 16 locked to the upper housing section 68.

For tensioning the stud 14 and engaging member 16 hydraulic fluid is admitted to the piston and cylinder power units 48, 48 through the oil duct so the piston heads 58 are actuated upwardly to raise the clamp assembly 70 and the upper housing section 68 to which the engaging member 16 is clamped. This exerts an upward pull on the stud 14.

While the stud 14 is held under tension the nut 26 is tightened by the chuck device via the socket 28 which is rotated by ring gear 32 attached socket 28. Ring gear 32 is driven by gear 36 driven by motor 40 to turn the nut 26 tight upon the structure 22. The hydraulic pressure can then be released from under the piston heads 58 to release the tension from the engaging member 16 and the stud 14. After the pressure is released, the clamp assembly 70 may be shifted to the open position shown in FIG. 2. This completes the operation by releasing the engaging member 16 enabling the housing 12 to be removed as desired.

Figure 5:
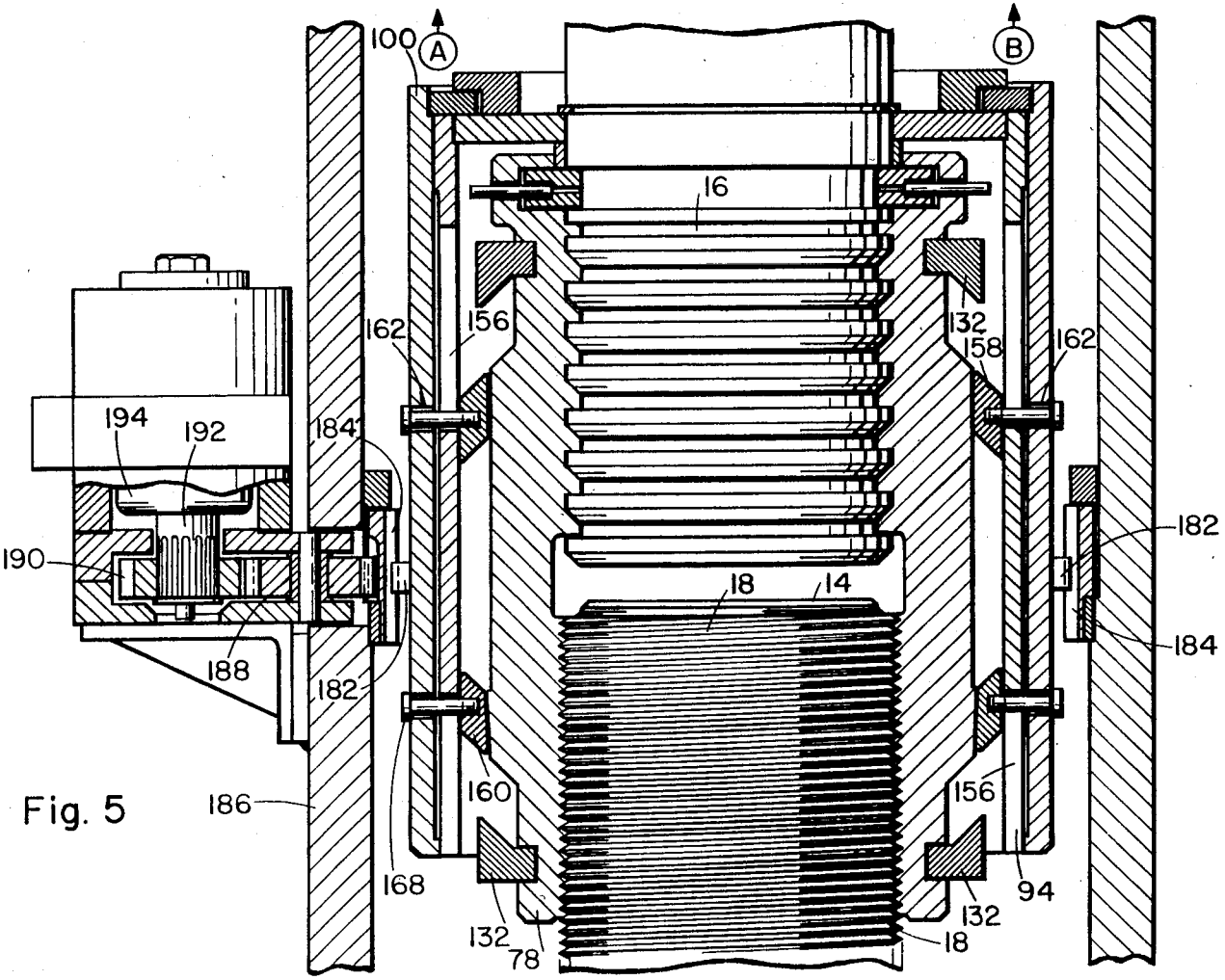
FIG. 5 is an elevational view in section showing another embodiment of a stud tensioner in the closed position.
Figure 6:
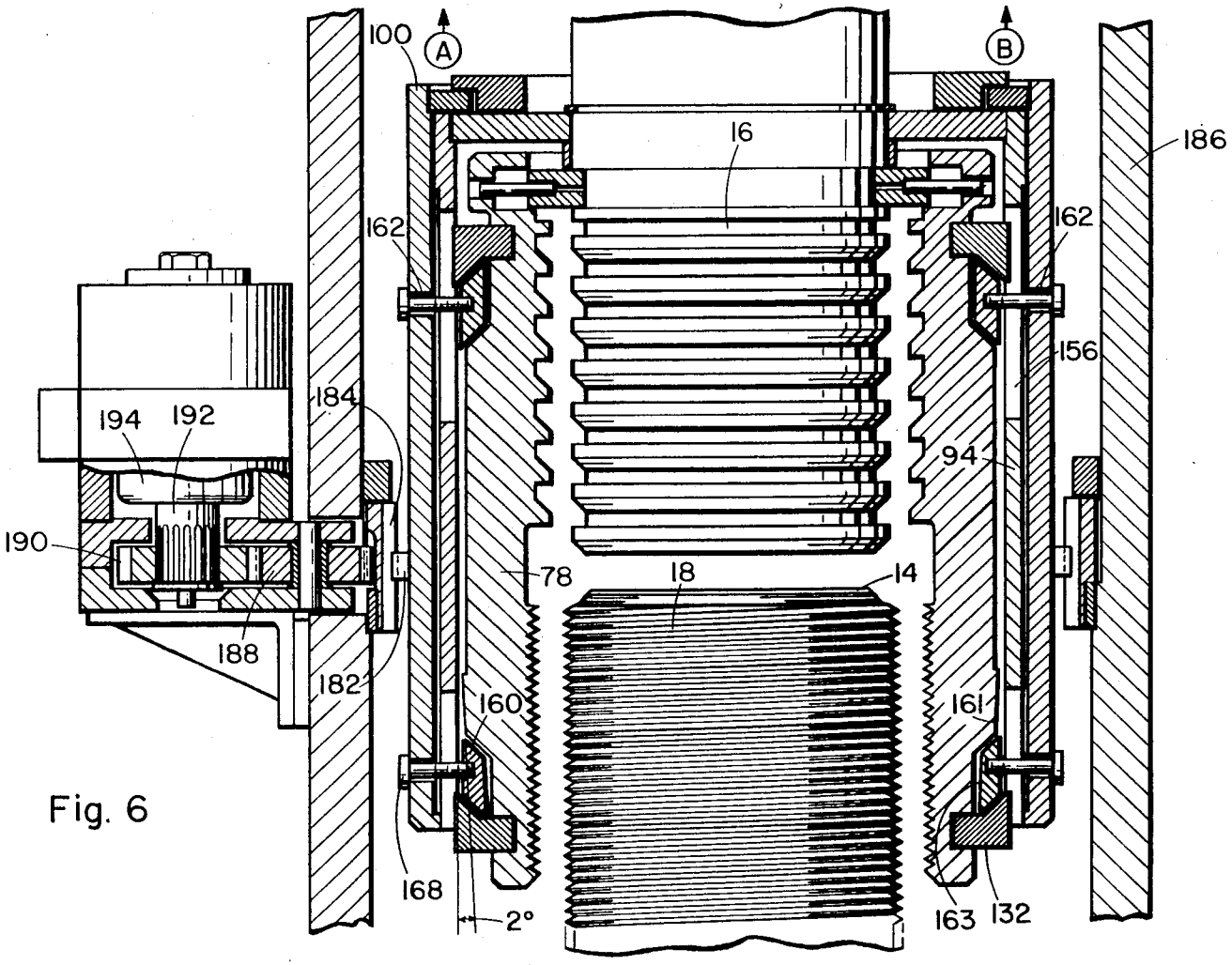
FIG. 6 is an elevational view in section of latter embodiment in the open position.

In another embodiment shown in FIGS. 5 and 6, the puller clamp 78 extends from the engaging member 16 to the threaded section 18 of the stud 14. Clamp 78 is activated by sleeve 100 which is rotatably disposed around stationary sleeve 94.

Sleeve 100 is driven by a lug 182 attached to the sleeve. A ring gear 184 mounted in outer sleeve 186 is driven by a pinion gear 188 mounted in outer sleeve 186. Pinion gear 188 is driven by motor gear 190 mounted on shaft 192 of motor 194.

Sleeve 100 actuates cams 158 and 160 through upper and lower slots 156 located in the sleeve. In operation, actuation of the sleeve 100 moves the cams to lock and unlock the puller clamp 78 as described in connection with FIGS. 1, 2 and 3.

Bottom surface 161 of stationary sleeve 94 has a slight taper, e.g. about 2° to mate with its landing ramp 163 of cam ring 160 to increase the pressure against thread 18 when the clamp 78 is in its closed position. Moreover, this slight tilt insures a better fit and improves alignment of the clamp and the stud threads.

Figure 7:
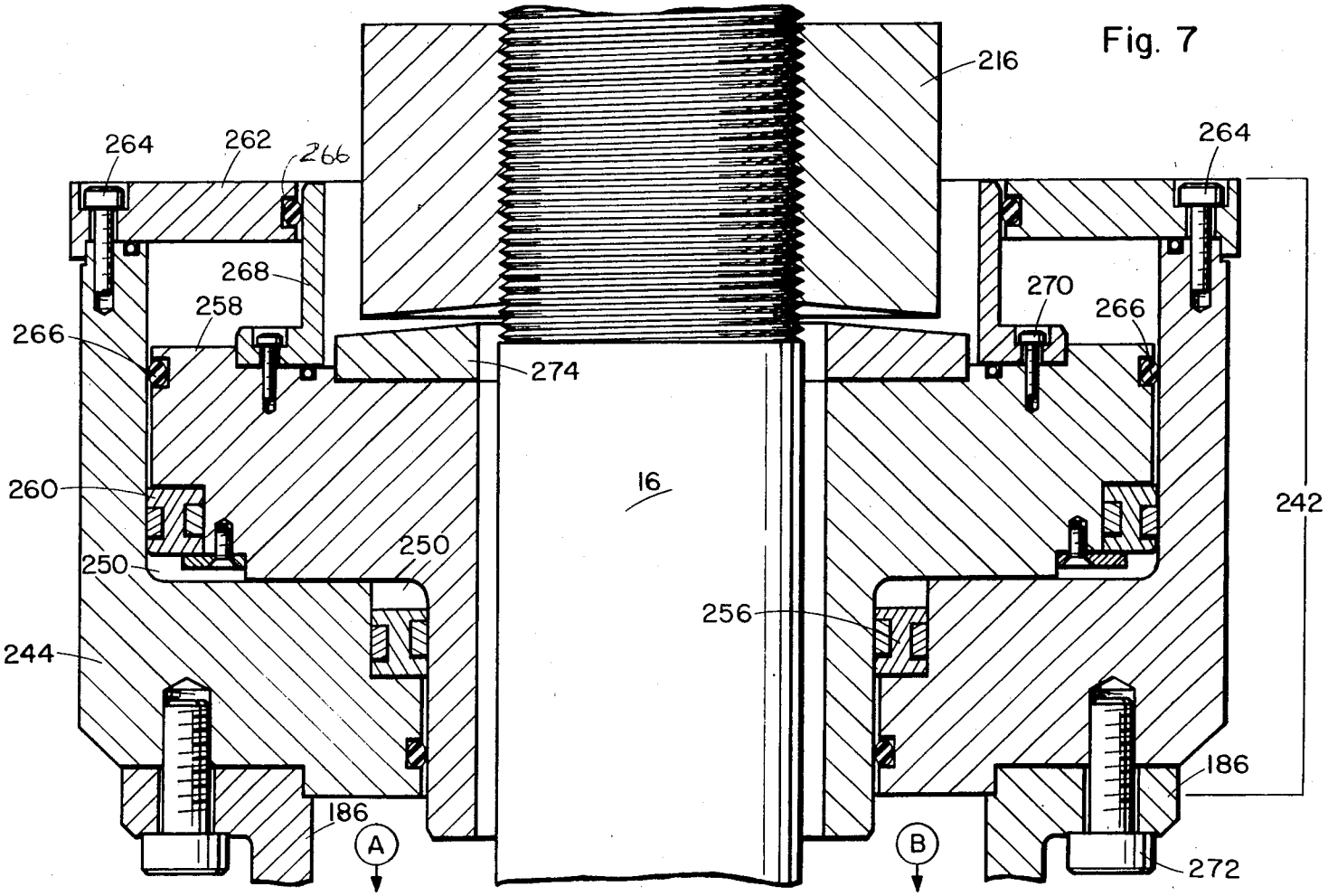
FIG. 7 is an elevational view in section of an extension of the embodiment shown in FIGS. 5 and 6.

FIG. 7 is an extension of the embodiment of the invention shown in FIGS. 5 and 6. It consists essentially of the top of the puller assembly 16 which is secured to the top of the housing by a nut 216.

The nut 216 which is screwed to the top of the puller bar or engaging member 16 moves upward by means of the action of cylinder 258, which is circumferentially disposed about the engaging member. Liquid is forced into chamber 250 to raise piston 258. Seal assemblies 256 and 260 maintain the pressure of the liquid in the cylinder 250 formed in the housing 244. The cylinder 244 is sealed at the top by means of plate 262 which is fastened to the wall of the cylinder 244 by means of cap screws 264. Seal assemblies 266 connect an inner wall 268 fastened to the top of the piston to maintain the integrity of the cylinder and to prevent external leakage of material into the top space in which the piston 258 will rise. The inner wall 268 is secured to the top of the piston by means of a series of screws 270.

The entire piston assembly is connected to the top of the outer wall 186 of the housing by means of set screws 272.

Therefore, as can be seen, the operation of the device is similar to that of the previous embodiment with the exception that the puller bar 16 is urged upward by means of the piston 258 acting on the spherical washer 274, which in turn urges the nut 216 upward, pulling the engaging member 16 upward. The upward force of the engaging member 16 is then transmitted to the connecting nut 78 which in turn pulls on the end of the stud 18.

It should be pointed out that although FIGS. 5 and 6 show the stud as having a threaded end, it is obvious that it could also work with a configuration of gripping rings in the same way that the bottom ends of engaging member 16 operate. In that case, the connecting nut 78 would also have a series of rings similar to that shown in 16. Obviously, the rings for the stud and for the bottom of the connecting unit, would be in the opposite direction of those shown for the engaging member 16 since the stresses would be operating in the opposite direction.

It should be pointed out that the invention described herein offers several advantages. The clamping mechanism is cam actuated which insures smoothness of operation. Additionally, it can be easily controlled during the operating cycle. The result is the clamping mechanism experiences and exerts minimum shock or trauma during its operating cycle. Consequently, the apparatus is reliable, durable, and minimizes the possibility of damaging the engaging members on which it operates.

It will be understood that various changes in the details, materials arrangements of parts and operating conditions which have been herein described and illustrated in order to explain the nature of the invention may be made by those skilled in the art within the principles and scope of the invention.

What is claimed is:

1. A tensioning device for an engaging member having a lower engaging section and an upper engaging section to be placed in tension to a predetermined load upon the lower engaging section, said device comprising:

(a) a stationary housing disposed about the engaging members;

(b) means within the housing to tension and release the upper engaging section;

(c) a cam and clamp assembly within the housing comprising a segmented clamp and a plurality of elements interconnected between the housing and the segmented clamp, said plurality of elements being moveable relative to one another, each of adjacent moving elements of the cam and clamp assembly moving in different modes from each other; and (d) drive means moving said segmented clamp between a closed position for clamping the engaging member and an open position for releasing the engaging member upon actuation of said cam and clamp assembly to close or open the clamp, said drive means including a motor and gear means connecting said motor to said clamp assembly.

2. A tensioning device for an engaging member as claimed in claim 1 wherein:

(a) the cam and clamp assembly comprises a plurality of concentric members including an actuating member, a camming member, and a segmented clamping member;

(b) the housing member is provided with a slotted guide and the actuating member is provided with a slotted guide forming an angle with and intersecting the slotted guide in the housing;

(c) pin means extending through the slotted guide of the housing and the actuating member external to the housing with the camming member within the housing; and (d) the camming member engaging and actuating the clamping member between an open and closed position with the engaging member to release or clamp the same with the assembly.

3. A tensioning device for an engaging member as claimed in claim 2 wherein:

(a) the housing has a plurality of sections;

(b) the tensioning means is a power piston assembly which when expanded places the engaging member under predetermined tension;

(c) an actuator sleeve is disposed about the housing, the actuator sleeve having a pair of converging slotted guides intersecting the slotted guide in the housing;

(d) a pair of cam rings are disposed within the housing;

(e) a pair of cam followers each extending through one of the slotted guides in the actuator sleeve and through the slotted guide in the housing connected to one of the cam rings;

(f) the segmented clamp has a plurality of circumferentially spaced segments around the engaging member;

(g) guide means in the housing slidingly engaging each of the segments and limiting the motion thereof toward or away from the engaging means; and (h) the cam rings contacting the outer circumference of the segments urging the segments toward or away from the engaging member in response to movement of the actuating sleeve whereby the engaging member will be clamped or released.

4. A tensioning device for an engaging member as claimed in claim 3 wherein:

(a) said drive means moving said segmented clamp between closed and open positions includes a sector gear connected to said clamp and an idler gear connected to said motor.

5. A tensioning device for an engaging member as claimed in claim 4 wherein:

(a) said housing has aligning means to engage and align the engaging member; and (b) the cam and clamp assembly is disposed about the engaging member in concentric relation to the axis thereof.

6. A tensioning device for an engaging member as claimed in claim 5 wherein:

(a) the cam rings have cam surfaces formed on each of the rings which are disposed axially one above the other;

(b) each of the segments have camming surfaces which coact with the camming surfaces of the rings.

7. A tensioning device for an engaging member as claimed in claim 6 wherein:

(a) each of the segments has a horizontal recess;

(b) a cam follower is disposed in the recess of each segment and extends radially outwardly therefrom; and (c) the cam rings engage the segments at axially spaced points to urge the segments toward the engaging member and engage the cam follower to urge the segments away from the engaging member.

8. A tensioning device for an engaging member as claimed in claim 7 wherein:

(a) the engaging member has ribs which interlock with ribs provided on the inner surfaces of the segments of the clamping and engaging member.

9. A tensioning device for an engaging member as claimed in claim 6 wherein one of the cam rings has a tapered surface which mates with a tapered surface of the clamping member to increase pressure against the engaging member and improve alignment therewith.

10. A tensioning device for an engaging member having a lower threaded engaging section and an upper threaded engaging section to be placed in the lower engaging section, said device comprising:

(a) a stationary housing disposed about the engaging members;

(b) a drive motor external to the stationary housing;

(c) means within the housing to tension and release the upper engaging section;

(d) a cam and a clamp assembly within the housing comprising a segmented clamp, a plurality of concentric members including an actuating member, a camming member and a segmented clamping member, the camming member engaging and actuating the clamping member between an open and closed position with the engaging member to release or clamp the same with the assembly; and (e) means connecting said drive motor and said camming member to actuate the clamping member between open and closed position.

11. A tensioning device as claimed in claim 10 wherein said connecting means extends through an opening in the housing.

12. A tensioning device as claimed in claim 11 in which said connecting means incudes a gear train.

13. A tensioning device as claimed in claim 12 in which the camming member comprises a pair of camming rings disposed within the housing and includes a pair of cam followers extending though a slotted guide in the activator sleeve, the motor drive means being connected to said cam followers.

14. A tensioning device as claimed in claim 13 in which the motor drive connecting means includes a gear train.

15. A tensioning device as claimed in claim 13 in which one of the cam rings has a tapered surface which fits with a corresponding surface of the clamping member.

* * * * *